United States Patent [19]

Gerzon

[11] 4,081,606

[45] Mar. 28, 1978

[54] SOUND REPRODUCTION SYSTEMS WITH AUGMENTATION OF IMAGE DEFINITION IN A SELECTED DIRECTION

[75] Inventor: Michael Anthony Gerzon, Oxford, England

[73] Assignee: National Research Development Corporation, London, England

[21] Appl. No.: 738,591

[22] Filed: Nov. 3, 1976

[30] Foreign Application Priority Data

Nov. 13, 1975 United Kingdom ..... 46822/75

[51] Int. Cl.[2] ..... H04R 5/00

[52] U.S. Cl. ..... 179/1 GQ; 179/100.4 ST

[58] Field of Search ..... 179/1 GQ, 1 G, 15 BT, 179/100.1 TD, 100.4 ST

[56] References Cited

U.S. PATENT DOCUMENTS

| | | | |
|---|---|---|---|
| 3,821,471 | 6/1974 | Bauer | 179/1 GQ |
| 3,856,992 | 12/1974 | Cooper | 179/1 GQ |
| 3,883,692 | 5/1975 | Tsurushima | 179/1 GQ |
| 3,885,101 | 5/1975 | Ito et al. | 179/1 GQ |
| 3,887,770 | 6/1975 | Takahashi | 179/1 GQ |
| 3,892,918 | 7/1975 | Takahashi et al. | 179/1 GQ |
| 3,997,725 | 12/1976 | Gerzon | 179/1 GQ |

*Primary Examiner*—Douglas W. Olms

*Attorney, Agent, or Firm*—Cushman, Darby & Cushman

[57] ABSTRACT

In a sound reproduction system, the phasiness of the psychoacoustically most important signals is minimized by subtracting from the velocity signal components of the most important signals a directional bias signal comprising a fraction of the pressure signal phase shifted by 90°.

10 Claims, 5 Drawing Figures

Figure 5:
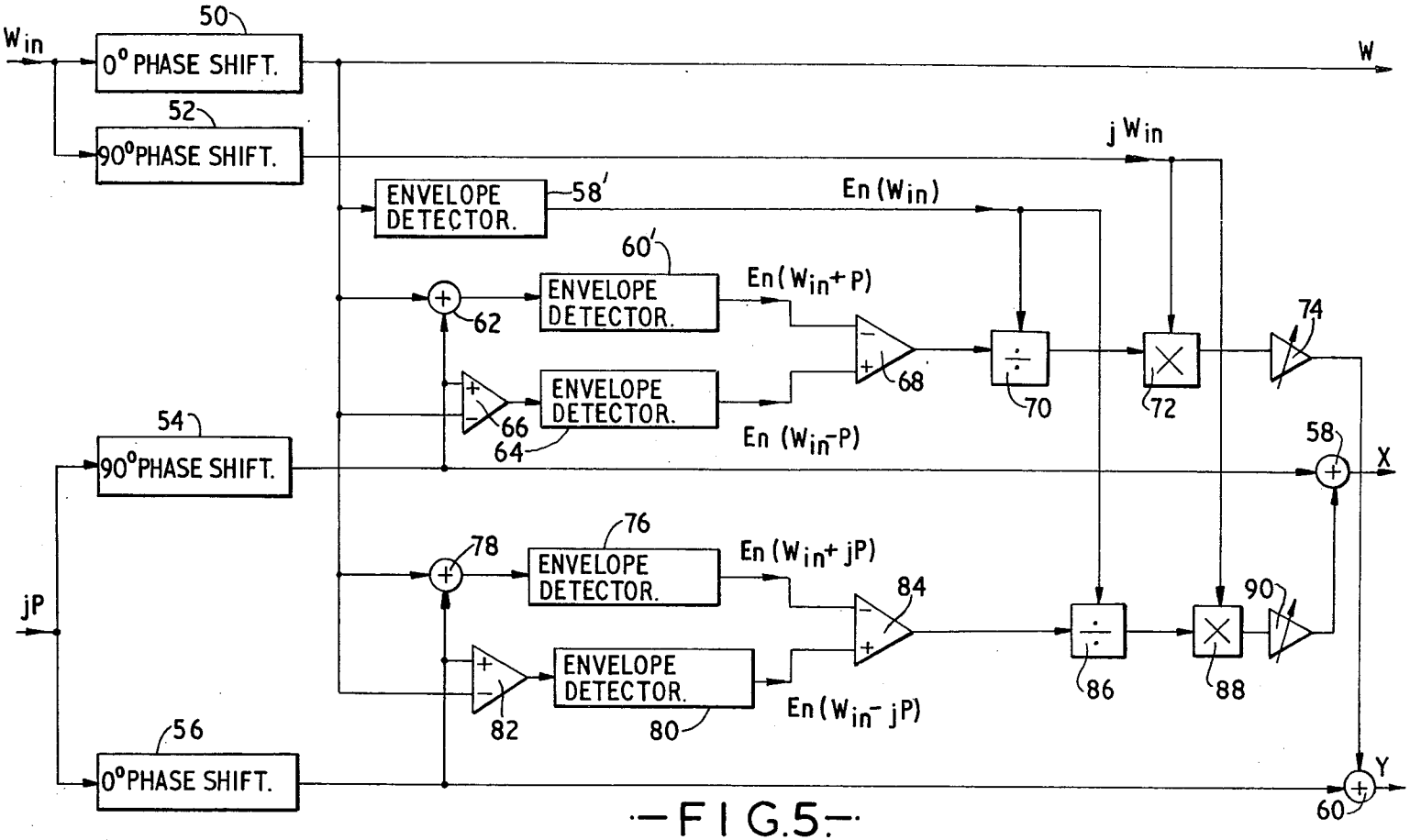

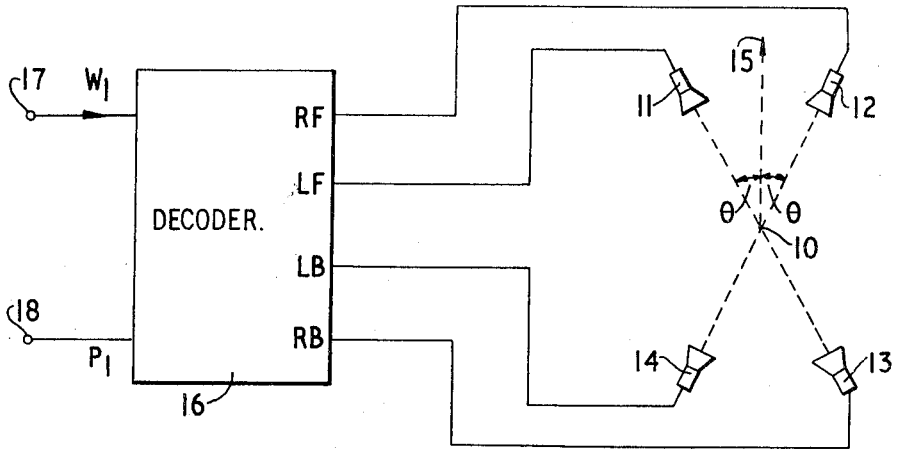
-FIG.1-
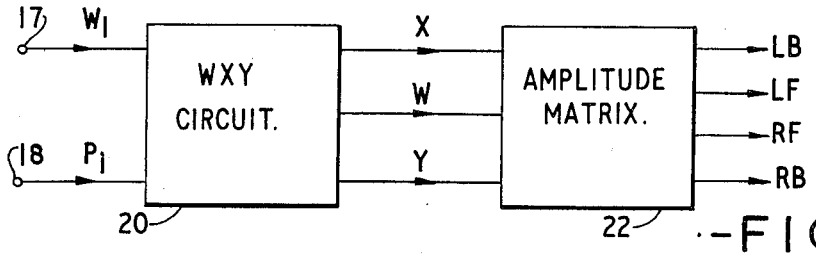
-FIG.2-
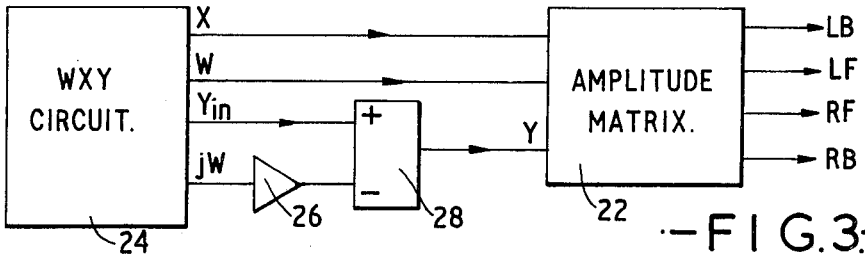
-FIG.3-
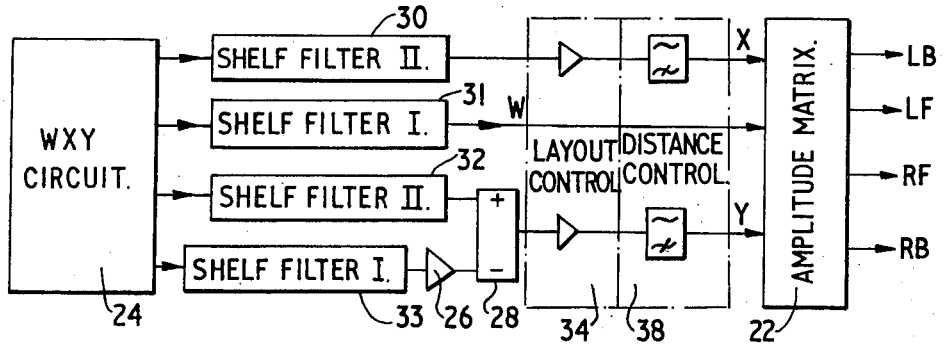
-FIG.4-

SOUND REPRODUCTION SYSTEMS WITH AUGMENTATION OF IMAGE DEFINITION IN A SELECTED DIRECTION

This invention relates to sound reproduction systems and more particularly to sound reproduction systems which enable the listener to distinguish sounds from sources extending over 360° of azimuth.

Co-pending U.S. application Ser. No. 430,519 and U.S. Pat. No. 3,997,725 are concerned with sound reproduction systems which enable the listener to distinguish sounds from sources extending over 360° of azimuth and which employ only two independent transmission channels. In one of these systems, one channel carries so-called omnidirectional signal components whch contain sounds from all horizontal directions with equal gain. The other channel carries so-called azimuth or phasor signal components containing sounds with unity gain from all horizontal directions but with a phase shift relative to the corresponding omnidirectional signal component which is related to, and is preferably equal to the azimuth angle of arrival measured from a suitable reference direction. In other systems, the signals of the two channels comprise linear combinations of the omnidirectional and phasor signals.

The phasor signal P may be resolved into components X and Y with a phase difference of 90°. For a sound at azimuth $\phi$ from the forward direction, the localisation is determined by $$\cos\phi : \sin\phi = \mathrm{Re}\,(X/W) : \mathrm{Re}\,(Y/W)$$

where W is the omnidirectional signal and Re means "the real part of". Thus the imaginary parts of X/W and Y/W do not contribute substantially to the sound localization. Instead they cause the sound signals to have an unpleasant quality commonly called "phasiness" which manifests itself in broad images that are hard to localize and sound very unnatural. It has been found that for a particular azimuth, the larger the ratio of the imaginary part of Y/W to the real part of Y/W, the worse phasiness for signals from that particular azimuth.

An omnidirectional signal is a particular one of a class of signals which represent the acoustic pressure signal available at a listening position. Similarly a phasor signal is a particular one of a class of signals which represent the acoustic velocity signals available at the same listening position. It should be understood that in the present specification the signal W may be any signal representing said acoustic pressure signal and the signals X and Y may be any signals representing orthogonal components of said acoustic velocity signals.

The present invention is concerned with minimising the phasiness of the psychoacoustically most important signals. In general, these are the signals from in front of the listener. However, if at any time, there is a dominant signal from a particular azimuth, it may be preferred to minimise the phasiness for this azimuth and to change the parameters of the decoding matrix as the azimuth of the most important sound alters. The invention is also applicable to decoders for systems which are subject to phasiness and have a higher number of channels than two and to decoders for three-dimensional systems which additionally distinguished between sounds originating at different heights and have a third signal Z, representing a third orthogonal component of the acoustic velocity signals, for this purpose.

According to the invention, there is provided a decoder for a sound reproduction system having at least three loudspeakers surrounding a listening area, the decoder comprising input means for receiving at least two input signals comprising pressure signal components and velocity signal components, means for subtracting from the velocity signal component of a chosen direction a directional bias signal comprising a signal all the components of which have a ± 90° phase relation with respect to the pressure signal components, and output means for producing a respective output signal for each loudspeaker.

This subtraction procedure is hereinafter called "directional biasing". In general the chosen direction will be the direction of the dominant or most significant signal. When the chosen direction is the forward direction, the procedure is called "forward biasing".

In the circumstances when all significant sound sources are, or a dominant sound source is, located at a particular azimuth at any one instant of time, the invention may provide means for determining such particular azimuth from the input signals and applying a bias signal dependent on such azimuth so as to compensate for phasiness of sources located thereat.

The pressure signal components may be omnidirectional signal components and the velocity signal components may be phasor signal components.

Thus, in accordance with the invention, the signals W, X and Y used to produce the output signals for a two-channel input signal, in which compensation for phasiness in the forward direction is required are as follows:

$$W = W_{in}$$

$$X = 1/\sqrt{2}\,P$$

$$Y = (1/\sqrt{2})\,j\,(P - k\,W_{in}) = (1/\sqrt{2})\,j\,P - (1/\sqrt{2})\,j\,k\,W_{in}$$

where $k$ is a positive constant between 0 and 1, preferably between $\frac{1}{3}$ and $\frac{1}{2}$. Subtraction of $jkW_{in}$ from Y does not alter sound localizations in any way but merely alters the phasiness by reducing the imaginary part of Y/W.

It should, of course, be understood that decreasing the phasiness at the front has the effect of increasing the phasiness of the back where P is negative. However, phasiness at the rear of the listener is psychoacoustically less important and an overall improvement is obtained.

Embodiments of the invention will now be described by way of example with reference to the accompanying drawings in which:

FIG. 1 is a schematic diagram of a sound reproduction system illustrating the disposition of the loudspeakers round a listening position and their connection to a decoder, FIG. 2 is a block diagram of a known decoder suitable for use in the system shown in FIG. 1, FIG. 3 is a block diagram of a decoder in accordance with a further embodiment of the invention, FIG. 4 is a block diagram of a decoder in accordance with another embodiment of the invention, and FIG. 5 is a block diagram of part of a decoder in accordance with a third embodiment of the invention.

It should be understood that, in the following description, where reference is made to a set of phase shifting circuits applying different phase shifts to different parallel channels, the phase shift specified in each case is a relative phase shift and a uniform additional phase shift may be applied to all channels if desired. Similarly, where it is specified that particular gains are applied to parallel channels, these gains are relative gains and a common additional overall gain may be applied to all channels if desired.

Before describing embodiments of the invention, it will be convenient to describe the basic form of a type of decoder suitable for use with rectangular loudspeaker layouts, hereinafter referred to as a WXY decoder. The invention may be applied to any decoder of this type.

Referring to FIG. 1, a listening location centred on the point 10 is surrounded by four loudspeakers 11, 12, 13 and 14 which are arranged in a rectangular array. The loudspeakers 11 and 12 each subtend an equal angle $\theta$ at the point 10 relative to a reference direction indicated by an arrow 15. A loudspeaker 13 is disposed opposite the loudspeaker 11 and the loudspeaker 14 disposed opposite the loudspeaker 12. Thus, assuming that the reference direction is the forward direction, the loudspeaker 11 is disposed at the left front position, loudspeaker 12 at the right front position, the loudspeaker 13 at the right back position and the loudspeaker 14 at the left back position. All four loudspeakers 11 to 14 are connected to receive respective output signals LF, RF, RB and LB from the decoder 16 which has two input terminals 17 and 18, the received omnidirectional signal $W_1$ being connected to the terminal 17 and the phasor signal $P_1$ to the terminal 18.

FIG. 2 shows a known WXY decoder suitable for use as the decoder 16 when the angle $\theta = 45°$. The decoder takes the form of a WXY circuit 20 and an amplitude matrix 22. The WXY circuit 20 produces an output signal W representing pressure, an output signal X representing front-back velocity and an output signal Y representing left-right velocity. These signals are then applied to the amplitude matrix 22 which produces the required output signals LB, LF, RF and RB.

The amplitude matrix 22 fulfils the function of the following group of equations:

$$LB = \tfrac{1}{2}(-X + W + Y)$$

$$LF = \tfrac{1}{2}(X + W + Y)$$

$$RF = \tfrac{1}{2}(X + W - Y)$$

$$RB = \tfrac{1}{2}(-X + W - Y)$$

Any decoder which produces the four output signals LB, LF, RF and RB is the equivalent of a WXY circuit and an amplitude matrix, and thus constitutes a WXY decoder, provided that $$\tfrac{1}{2}(-LB + LF - RF + RB) = 0$$

The WXY circuit 20 may have more than two inputs. In fact this decoder is the same as the decoder shown in FIG. 5 of the above-mentioned U.S. application Ser. No. 430,519 the 90° phase shift circuits serving as the active part of the WXY circuit 20 and the adders and phase inverters serving as the amplitude matrix 22.

The nature of the WXY circuit depends on the form of the input signals. If, as shown, the input signals comprise an omnidirectional signal $W_1$ and a phasor signal $P_1$ of the same magnitude as the omnidirectional signal but with a phase difference equal to minus the azimuth angle, the outputs of the WXY circuit 20 are related to its inputs as follows:

$$W = W_1$$

$$X = (1/\sqrt{2})\, P_1$$

$$Y = (1/\sqrt{2})\, jP_1$$

FIG. 3 shows a decoder similar to that of FIG. 2 but forward biased in accordance with the invention. The forward biased decoder comprises a WXY circut 24 which is similiar to the WXY circuit 20 except that it has an additional $j$W output. The X and W outputs are connected directly to the amplitude matrix 22 as before. The jW output is connected via a variable gain amplifier 26 to a subtraction circuit 28 where it is subtracted from the Y output of the WXY circuit 24. The output Y of the subtraction circuit 28 is connected to the amplitude matrix 22. The gain of the amplifier 26 is set to $k$, i.e. a positive value between 0 and 1 as stated above. Conveniently, in the case when the WXY circuit 20 received two input signals comprising omnidirectional and phasor signal components $k$ may be in the range from $\frac{1}{3}$ to $\frac{1}{2}$.

A similar modification may be made to any of the WXY decoders described in co-pending application Ser. No. 560,865. The subtraction of the $j$W signal from the Y signal may be carried out at any convenient point between the WXY circuit and the amplitude matrix. Conveniently, this subtraction is carried out on the output signals from the WXY circuit but other arrangements are possible. For example, as shown in FIG. 4 of the present specification, the output of the WXY circuit 24 may be connected to respective shelf filters 30 to 33, the shelf filter 31 for the W signal being a type I shelf filter and the shelf filters 30 and 32 will be X and Y signals being type II shelf filters as described in the above mentioned co-pending application. The shelf filter 33 for the $j$W signal is a type III shelf filter which has a matched phase response identical to those of the types I and II shelf filters. This enables the constant $k$ to be frequency dependent so that the degree of residual phasiness can be controlled according to the sensitivity of the human ear to phasiness at each frequency. However a design simplification or economy of apparatus may be achieved by making the type III shelf filter the same as the type I shelf filter in which case the function of these two filters can be performed by a single filter operating on the W signal, and a 90° phase shift circuit used to produce the $j$W signal from the output of this filter. The signals are then applied to a lay-out control stage 34 and a distance control stage 38 substantially as described in the above-mentioned co-pending application Ser. No. 560,865.

The subtraction of the $j$W signal may also be performed after the lay-out control stage 34 and/or the distance control stage 38 although this will mean that the resulting compensation for phasiness will vary with these adjustments.

The application of the invention is not limited to decoders having omnidirectional and phasor inputs but can also be applied to more general classes of signals encoded on two channels. For example it may be applied to an encoding method such that one linear combination A of the two channels may be considered to be an omnidirectional signal and another linear combination B may be considered to be $(\cos\phi - jq\sin\phi)$ times that of the linear combination A, where $\phi$ is chosen suitably for each encoded sound position and $q$ is a real non-zero constant. $\phi$ may be equal to the intended azimuth angle during the encoding process or may be some function of that angle. In the following decoding equations, $\phi$ is treated as the angle from which the sound will be heard after decoding.

The decoder for such signals will have the following equations;

$$W = A$$

$$X = \alpha B$$

$$Y = \alpha j q^{-1} (B - kA)$$

where $\alpha$ is a constant which may be frequency-dependent and *k is a positive constant less than* 1. The subtraction of $k$A from the signal Y is the process of forward biasing in accordance with the invention so as to minimise 90° phase shifted components of Y for sounds for which $\phi$ is near zero. The value of $\alpha$ will ideally be about $\sqrt{2}$ at frequencies substantially below 350 Hz and around $1/\sqrt{2}$ at substantially higher frequencies.

The effect of the forward bias term in the above expression for Y is not only to reduce the phasiness of sounds towards the front but also to increase the gain of sounds from the back and to reduce that of sounds from the front. This may help to compensate for any relative excessive gains at the front in the signals A and B during encoding. There are several systems in which such excessive front gain exists.

For example, the invention may be applied to two channel signals where the signals in the two channels are linear combinations of C and D (possibly involving phase shifts) where C has gain $(1 + \mu \cos \phi + \mu j \sin \phi)$ and D has gain $(\mu + \cos \phi - j \sin \phi)$ where $\mu$ is a non-zero constant. Both signals have the same gains for all azimuths and the signal D lags the signal C by a phase angle $\phi$, just as for an omnidirectional/phasor encoding, but C does not have constant gain with angle, its actual energy gain being $(1 + \mu^2 + 2\mu \cos \phi)$ at azimuth $\phi$. Where $\mu$ is positive, this gain is higher at the front than at the back and these signals may be decoded by treating C as an omnidirectional signal and D as a phasor signal and using the forward biasing to help to restore equality to the gains during reproduction as well as giving lower phasiness for sounds from the front.

The invention may also be applied to three-channel systems of the type in which the third channel is of poorer quality than the other two channels. For example, on a three-channel record, the two high quality channels may be base band channels and the third channel recorded using a subcarrier.

In one three-channel system the three transmitted signals are $W_{in}$, P and P* where P* is the signal whose directional gain is the complex conjugate of that of P. The respective gains of the three signals at azimuth $\phi$ are 1, $(\cos \phi - j \sin \phi)$ and $(\cos \phi + j \sin \phi)$. An "ideal" WXY circuit for these three channels, without forward biasing, is given by:

$$W = W_{in}$$

$$X = \beta (\tfrac{1}{2}P + \tfrac{1}{2}P^*)$$

$$Y = \beta (\tfrac{1}{2}jP - \tfrac{1}{2}jP^*)$$

where $\beta$ is a real constant which may be frequency-dependent. This decoder does not suffer from phasiness but gives equal significance to the signals P and P*. In order to reduce the significance of the supposedly low quality signal P*, the following type of decoder has been proposed:

$$W = W_{in}$$

$$X = \beta [tP + (1 - t)P^*]$$

$$Y = \beta [tjP - (1 - t)jP^*]$$

where $t$ is a positive number between $\frac{1}{2}$ and 1. If $t = \frac{1}{2}$ the resulting decoder is the full three-channel decoder described above and where $t = 1$ the resulting decoder is a two-channel decoder. $t$ can vary with frequency if desired. This system is subject to phasiness and in order to reduce phasiness for front images, it may be forward biased as follows:

$$W = W_{in}$$

$$X = \beta [tP + (1 - t)P^*]$$

$$Y = \beta [tjP - (1 - t)jP^* - k(2t - 1)jW_{in}]$$

Although the undesirable side effects of increase in the gain at the back relative to that at the front also occurs, the magnitude of this effect is less than that for a two-channel decoder.

In a full three-channel system, there are signals other than $jW$ that have 90° phase shift relative to W for all azimuths. Any real linear combination of $jW$, $j(P + P^*)$ and $(P - P^*)$ has the required 90° phase shift. Consequently, a three-channel decoder can be forward biased without affecting its basic image localization by adding any real linear combination of these three signals to X and Y in the basic decoder equation. Such bias need not necessarily be in the forward direction (in which case it is not forward bias) and may be used to alter the gain of the decoder in some directions relative to others.

With some encoded signals, all significant sound sources or a dominant sound source may be located at a particular azimuth at any one instant of time. In these circumstances, it may be desirable to apply a bias signal to reduce the imaginary components of the velocity signal components signal for this particular azimuth.

More specifically, a decoder matrix for this purpose may have the following decoding equations:

$$W = W_{in}$$

$$X = \gamma(P + ju\, W_{in})$$

$$Y = \gamma(jP + j\, v\, W_{in})$$

where $\gamma$ is a real constant which may be frequency dependent and $u$ and $v$ are real numbers, representing gains, which vary according to the deduced distribution of sounds in the encoded signals.

If it is deduced that all the sounds in the encoded signals are at azimuth $\phi$ then the ideal values of $u$ and $v$ are $$u \cong \sin \phi$$

$$v \cong -\cos \phi$$

in order to cancel out the 90° phase shifted components of X and Y. If the general tendency of sounds is to be towards azimuth $\phi$, but with a certainty $r < 1$. (where $r$ may be related to the spread of sound sources away from azimuth $\phi$), then putting:

$$u \simeq r \sin \phi$$

$$v \simeq -r \cos \phi$$

gives acceptable results. Inaccuracies in the estimates for $\phi$ and $r$ do not affect the subjective results very critically because azimuths near $\phi$ are also decoded with relatively low phasiness.

Several methods estimating $\phi$ and $r$ are known and one technique will be described by way of example. FIG. 5 illustrates a WXY circuit incorporating variable bias in accordance with the invention for decoding the signals $W_{in}$ and jP.

The $W_{in}$ signal is applied to a 0° phase shift circuit 50 for producing the signal W and to a 90° phase shift circuit 52 for producing the signal $jW_{in}$ Similarly, the phasor signal $jP$ is applied to a −90° phase shift circuit 54 and a 0° phase shift circuit 56. The outputs of the phase shift circuits 54 and 56 are connected via respective adders 58 and 60 to the X and Y outputs of the WXY circuit, the adders 58 and 60 being used to apply the required biasing as will now be described.

It can be shown that for practical purposes cos $\phi$ and sin $\phi$ can be considered as given by $$-2r \cos \Phi = \frac{En(W_{in} - P) - En(W_{in} + P)}{En(W_{in})}$$

and $$2r \sin \Phi = \frac{En\,(W_{in} + jP) - En(W_{in} - jP)}{En(W_{in})}$$

where En(S) means the envelope of a wave form S.

In the circuit shown in FIG. 5, the omnidirectional signal $W_{in}$ is applied to an envelope detector 58' to produce the signal $En(W_{in})$ which is the denominator of both the above expressions. The signal $En(W_{in} + P)$ produced by an envelope detector 60' responsive to an adder 62 and the signal $En(W_{in} - P)$ is produced by an envelope detector 64 which is responsive to a subtraction circuit 66. The outputs of the envelope detectors 60' and 64 are applied to a subtraction circuit 68 to produce the numerator of the expression for cos $\phi$ and this is divided by the output of the envelope detector 58' in a divider 70. The output of the divider 70 is multiplied by $jW_{in}$ in a multiplier 72 to obtain the required biasing signal for the Y output. This biasing signal is then applied via a variable gain amplifier 74 to the adder 58.

The biasing signal for the X output is obtained in a similar manner. The signal $En(W_{in} + jP)$ is produced by an envelope detector 76 which is responsive to an adder 78. The signal $En(W_{in} - jP)$ is produced by an envelope detector 80 which is responsive to a subtraction circuit 82. The outputs of the envelope detectors 76 and 80 are applied to a subtraction circuit 84, the output of which is divided by the output of the envelope detector 58' in a divider 86. The output of the divider 68 is multiplied by the output of the phase shift circuit 52 in a multiplier 88 and the resulting biasing signal is applied to the adder 60 via an amplifier 90.

Thus the biasing signals applied to the X and Y outputs of the circuit shown in FIG. 5 are dependent on the azimuth of the dominant sound represented by the coded signals $W_{in}$ and P and the magnitude of the biasing signals depends on the amplitude of the dominant signal as compared with the amplitude of signals from other directions. If sounds of equal intensity come from directions of widely differing azimuth so that there is no dominant signal, the inputs to the subtraction circuits 68 and 84 will be equal so that their outputs are zero.

A simplified variable bias decoder may be obtained by applying a variable bias signal only to the Y output of the WXY circuit and not to the X output, i.e. by putting $u$ equal to zero. This will "enhance" directional resolution to the front and/or the back but not at the sides.

Directional biasing may also be applied to non-rectangular loudspeaker layouts. For example, in a regular polygonal array, the signal fed to each loudspeaker may be:

$$k_1 W + k_2 (X' + k_3 jW) \cos\theta + k_2 (V' + k_4 jW) \sin\theta$$

where X' and Y' are the velocity signal outputs of the WXY circuit and $k_1$ and $k_2$ are both greater than zero and where $\theta$ is the azimuth of the loudspeaker to which the signal is fed. The terms $k_3 jW$ and $k_4 jW$ are the directional bias terms. $k_1$, $k_2$, $k_3$ and $k_4$ may be frequency dependent and/or may be dependent on the supposed instantaneous direction of the dominant signals but otherwise they are real constants. The circuitry required to implement such polygonal decoders differs from that illustrated in FIGS. 2 to 5 only in that the output amplitude matrix 22 is replaced by an amplitude matrix having $n$ outputs $S_i$ (corresponding to loudspeakers at azimuths $\theta_1, \ldots \theta_n$ spaced apart by 360°/$n$ ) given by $$S_i = k_1 W + k_2 X \cos\theta_i + k_3 Y \sin\theta_i$$

When directional biasing is applied to three-dimensional systems, biasing may be applied to the Z component of the velocity signal as well as or instead of the X and/or Y components.

I claim:

1. A decoder for a sound reproduction system having at least three loudspeakers surrounding a listening area, the decoder comprising input means for receiving at least two input signals comprising pressure signal components and velocity signals comprising pressure signal components and velocity signal components of a plurality of directions, subtractor means, responsive to the input means, for subtracting from those velocity signal components of a chosen direction a directional bias signal comprising a signal all the components of which differ in phase from the pressure signal components by 90°, and output means, responsive to the input means and the subtractor means, for producing a respective output signal for each loudspeaker.

2. A decoder according to claim 1, wherein the directional bias signal is a fraction of the pressure signal phase shifted by 90°.

3. A decoder according to claim 2, wherein the fraction of the pressure signal is in the range of one third to one half thereof.

4. A decoder according to claim 2, wherein the pressure signal components are omnidirectional signal components and the velocity signal components are phasor signal components.

5. A decoder according to claim 1, wherein the input means is adapted to receive three input signals and derive therefrom a pressure signal and two velocity signals which, for all sounds are either in phase or 180° out of phase with the pressure signal, the signal subtracted from the velocity signal being real linear combinations of the pressure signal phase shifted by 90° and the velocity signals phase shifted by 90°.

6. A decoder according to claim 5, wherein the two velocity signals are respectively the sum of a phasor signal and its complex conjugate and the difference between the phasor signal phase shifted by 90° and its complex conjugate.

7. A decoder according to claim 1, including means responsive to the input signals for determining the azimuth angle of the most significant sound source and means for applying a directional bias signal dependent on said azimuth angle.

8. A decoder according to claim 7, including means for producing first and second mutually orthogonal components of the velocity signal of azimuths 0° and 90° respectively and means for applying a first directional bias signal to said first component and a second directional bias signal to said second component.

9. A decoder according to claim 8, wherein the magnitude of the first directional bias signal is proportional to minus the cosine of said azimuth angle and the magnitude of the second directional bias signal is proportional to the sine of said azimuth angle.

10. A decoder according to claim 9, wherein the bias signal applied to the first of said mutually orthogonal components is proportional to the difference between the envelope of the difference between the pressure and velocity signals and the envelope of the sum of the pressure and velocity signals divided by the envelope of the pressure signal and the bias signal applied to the second of said mutually orthogonal components is the difference between the envelope of the sum of the pressure signal and the omnidirectional signal phase shifted by 90° and the envelope of the difference between the pressure signal and the omnidirectional signal phase shifted by 90° divided by the envelope of the pressure signal.

* * * * *